United States Patent [19]

Yanobu

[11] 4,377,065

[45] Mar. 22, 1983

[54] DOUBLE TWISTER

[75] Inventor: Hideo Yanobu, Kyoto, Japan

[73] Assignee: Murata Kikai Kabushiki Kaisha, Kyoto, Japan

[21] Appl. No.: 276,832

[22] Filed: Jun. 24, 1981

[30] Foreign Application Priority Data

Jun. 26, 1980 [JP] Japan ..... 55/87629

[51] Int. Cl.[3] ..... D01H 13/10; D01H 7/86; D01H 15/00

[52] U.S. Cl. ..... 57/279; 57/58.86

[58] Field of Search ..... 57/58.49, 58.83, 58.86, 57/279, 280, 58.7

[56] References Cited

U.S. PATENT DOCUMENTS

| | | | |
|---|---|---|---|
| 2,715,308 | 8/1955 | Soussloff et al. | 57/279 X |
| 3,731,478 | 5/1973 | Franzen | 57/58.7 |
| 3,945,184 | 3/1976 | Franzen | 57/58.86 |
| 4,030,683 | 6/1977 | Eckholt | 57/58.86 X |
| 4,168,605 | 9/1979 | D'Agnolo | 57/279 |
| 4,355,500 | 10/1982 | Yanobu et al. | 57/279 |

*Primary Examiner*—John Petrakes
*Attorney, Agent, or Firm*—Moonray Kojima

[57] ABSTRACT

A double twister provided with a pneumatic yarn guide means and tension regulating means including a hollow yarn guide tube inserted slidably in a central hole of a yarn supply bobbin of the double twister, a first spring for urging upward the hollow yarn guide tube and a second spring which is wound on the upper end of the yarn guide tube and may bring a flyer boss supporting member into pressing contact with a brake disc.

5 Claims, 9 Drawing Figures

DOUBLE TWISTER

BACKGROUND OF THE INVENTION

In an ordinary double twister, a yarn unwound from a yarn supply bobbin supported on a stationary disc is guided into the central hole of the yarn supply bobbin from the top of the central hole of the bobbin, passed through a tension device such as a capsule tensor or ball tensor, travelled from the central hole of a spindle to the center of a yarn storing disc and delivered to the outside of the yarn storing disc through a yarn guide hole extended from the center of the yarn storing disc in the radial direction. Then, the yarn is wound on the peripheral surface of the yarn storing disc at a certain winding angle and is raised on the outer wall surface of the yarn storing disc, and the yarn is separated from the top end portion of said wall surface and then delivered upward while being ballooned. Then, the yarn is passed through a yarn guide located on an extension of the central line of the bobbin and is wound by a winding device disposed above.

When pneumatic yarn passage is carried out in such double twister, it is necessary to form an air circulation passage and produce a sucking force in the yarn guide hole by jetted air. However, in the tensioning zone comprising the above-mentioned tensor such as a capsule sensor or ball tensor and a yarn contact guide supporting the tensor thereon, the air circulation passage is intercepted, and therefore, a sucking force cannot be produced in this zone. Accordingly, when pneumatic yarn passage is carried out in the above-mentioned ordinary double twister, it is necessary that the tensor should be separated from the center of the opening of the yarn contact guide, and at the time of yarn passage, it is necessary that the tensor should be deviated from the center of the yarn guide hole by using a tensor escape member and air should be jetted while the tensor is maintained in this deviated state. Accordingly, the operation is complicated and troublesome.

Furthermore, in an ordinary double twister, the balloon tension is always maintained at a certain level, and as factors determining this balloon tension, there can be mentioned, for example, the rotation number and diameter of the yarn storing board, the fineness of the yarn to be treated, the air resistance, the tension applied by the tensor, the friction of the yarn wound on the outer surface of the yarn storing board and the unwinding tension on the yarn unwound from the yarn supply bobbin.

Among these factors, the rotation number and diameter of the yarn storing disc, the air resistance and the tension by the tensor are fixed in one double twister, and as variable factors, there can be mentioned the unwinding tension and the winding angle of the yarn on the yarn storing disc.

More specifically, the larger is the diameter of the yarn supply bobbin, the smaller is the unwinding tension, and as the yarn is unwound and the diameter of the yarn supply bobbin is reduced, the unwinding tension is increased. With this variation of the unwinding tension, the winding angle of the yarn on the yarn storing disc is changed, whereby the balloon tension is maintained at a constant level. More specifically, with increase of the unwinding tension, the winding angle is decreased and the contact length of the yarn is decreased, with the result that the friction is decreased and a certain balloon tension is consequently mantained. In this connection, it must be noted that the yarn is wound at a certain angle on the peripheral surface of the yarn storing disc until the yarn on the bobbin is wound to such extent that no yarn is left on the bobbin. If the winding angle of the yarn is reduced to zero, variations of the unwinding tension cannot be absorbed in the yarn storing disc any more and yarn breakage takes place. On the contary, if a tensioning device such as a tensor is not disposed, the yarn is wound by several turns on the yarn storing disc, and yarn breakage takes place also in this case.

Therefore, in an ordinary double twister, a spring of a capsule tensor built in the central hole of the bobbin is adjusted in advance, or in case of a ball tensor, the number of balls is increased or decreased in advance, and the tensor tension is thus adjusted so that the yarn is wound on the yarn storing disc at a certain angle up to completion of the winding operation while the winding angle is being changed by changes of the unwinding tension on the yarn.

SUMMARY OF THE INVENTION

The present invention relates to a double twister and more specifically relates to a double twister in which a tensor is not disposed in a yarn guide hole and which includes means for absorbing variations of the unwinding tension.

The present invention has been accomplished to eliminate the aforementioned disadvantages.

It is a primary object of the present invention to provide a double twister in which a tensor is not disposed in a yarn guide hole and hence, an air circulation passage is always formed and in which variations of the unwinding tension can effectively be absorbed so that a winding angle of the yarn on the yarn storing disc can be guaranteed assuredly.

DETAILED DESCRIPTION OF THE INVENTION

The present invention will now be described in detail with reference to embodiments illustrated in the accompanying drawings.

Figure 1:
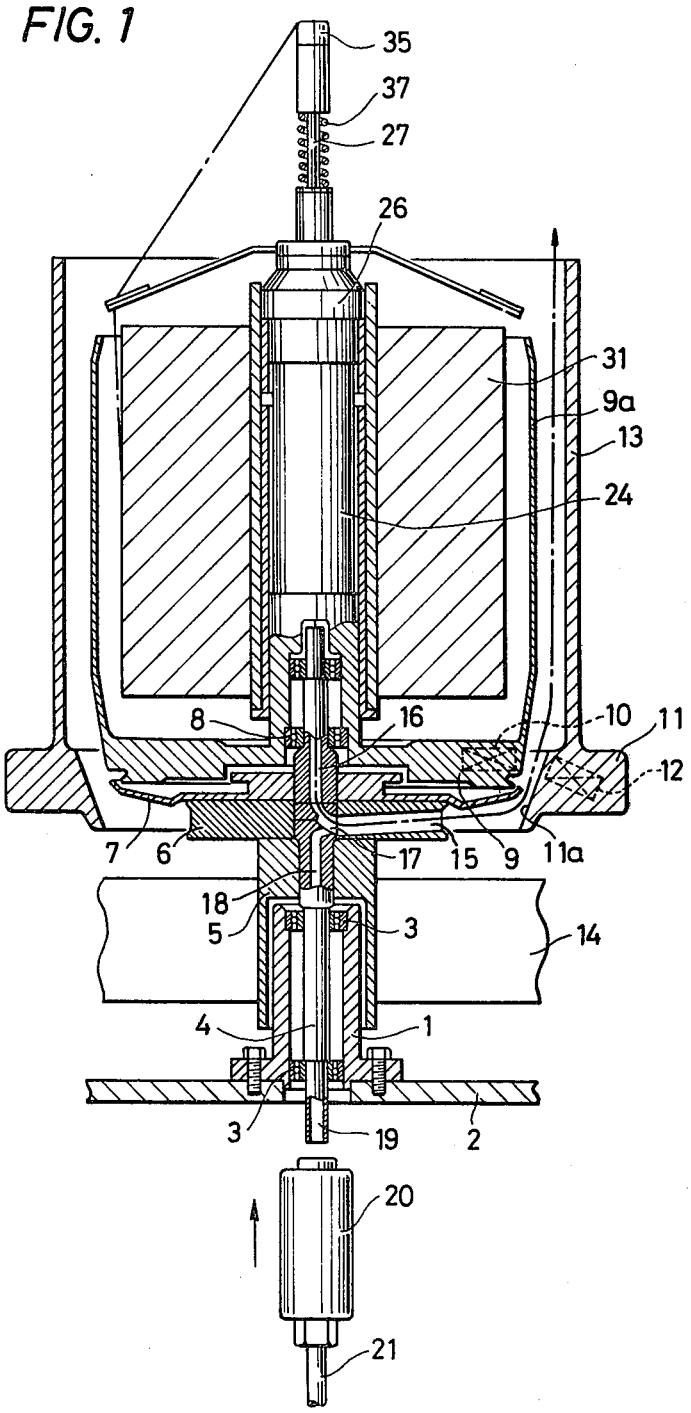
FIG. 1 is a sectional front view illustrating one embodiment of the present invention.

Referring to FIG. 1, a supporting tube 1 is secured to a frame 2, and a spindle 4 is rotatably supported on the supporting tube 1 through a bearing 3. A wharve 5, a yarn storing disc 6 and a rotary disc 7 are integrally secured to the spindle 4.

A stationary disc 9 is supported on the spindle 4 through a bearing 8, and this stationary disc 9 is immovably secured by attracting forces of a magnet 10 built in the stationary disc 9 and a magnet 12 built in an outer ring 11 having an upwardly expanded inclined surface 11*a*.

An outer balloon restricting cylinder 13 is secured, together with the outer ring 11, onto the frame 2, and a running belt 14 is brought into pressing contact with the wharve 5 to rotate the spindle 4.

A yarn guide tube 15 is extended in the radial direction in the interior of the yarn storing disc 6 and is communicated through an inclined hole 17 with a yarn guide hole 16 formed at the center of the spindle 4. Furthermore, an air hole 19 having the lower end opened and also having on the top end thereof a jetting hole 18 for jetting air into the yarn guide disc 15 is formed at the center of the spindle 4.

A compressed air supply valve 20 is disposed below the spindle 4 to supply compressed air to the air hole 19 of the spindle 4. The valve 20 is slidable in the vertical direction along the central axis of the spindle 4 and can be coupled with the lower end of the spindle 4 by a manual or automatic operation. Reference numeral 21 represents a pipe connected to a compressed air supply source.

Figure 2:
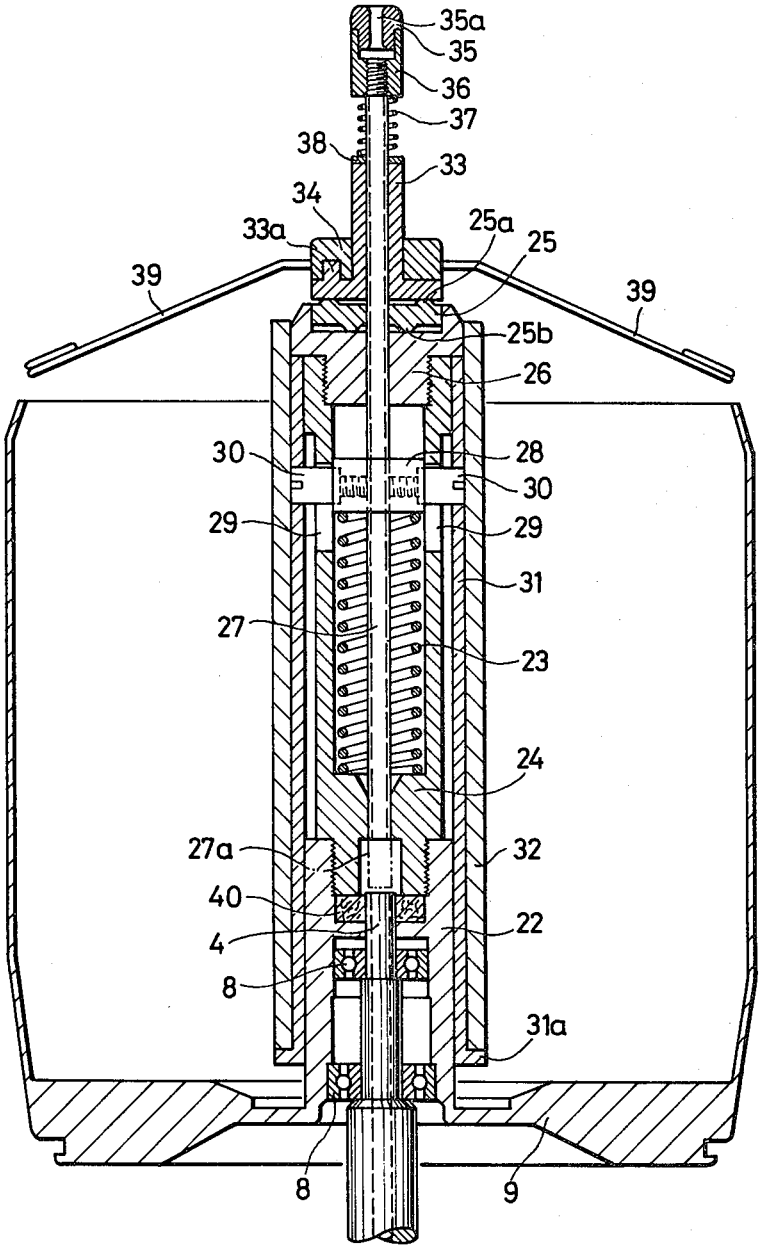
FIG. 2 is a sectional view illustrating the main portion of the apparatus shown in FIG. 1.

Referring to FIG. 2 illustrating the main portion of the present invention, a cylindrical spring case 24 including a first spring 23 therein is screwed to a central cylindrical portion 22 of the stationary disc 9, and a brake disc supporting member 26 is screwed to the top end of the case 24 to support a brake disc 25 thereon. A yarn guide tube 27 is inserted through the centers of the spring case 24 and the brake disc supporting member 26, and a disc-like spring seat 28 is inserted and fixed at a predetermined position of the yarn guide tube 27 in the interior of the spring case 24. Pins 30 piercing through long holes 29 formed in the spring case 24 are fitted in the spring seat 28 to regulate the upper limit position of the spring-urged spring seat 28. The heads of the pins 30 are fitted in a bobbin supporting member 31 attached to the spring case 24 and the cylindrical portion 22 of the stationary disc 9 to support the bobbin supporting member 31. The bobbin supporting member 31 has a cylindrical shape having a flange 31*a* formed on the lower end thereof, and the yarn supply bobbin is supported on the bobbin supporting member 31 by placing a cone 32 of the bobbin on the flange 31*a*. The bobbin supporting member 31 is slidable in the vertical direction with vertical movement of the pins 30 in the long hole 29. A brake disc 25 is mounted on the top face of the brake disc supporting member 26.

Figure 3:
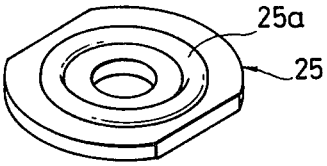
FIG. 3 is a perspective view illustrating a brake disc.

As shown in FIG. 3, the brake disc 25 is formed by cutting off the peripheral surface portion from a disc, and the brake disc 25 is immovably disposed in the upper recess of the supporting member 26. An annular projecting band 25*a* is formed on one surface of the disc brake 25, and an annular projecting band 25*b* having a smaller diameter than that of the band 25*a* is formed on the other surface of the brake disc 25. The brake disc 25 may be used either in the state where the projecting band 25*a* is located on the upper side or in the state where the projecting band 25*b* is located on the upper side, and an optional location is selected according to the kind of the yarn to be treated and the value of the unwinding resistance.

A flyer boss supporting member 33 is mounted on the projecting band 25*a* on the top face of the brake disc 25, and the recess of a flyer boss 34 is fitted in a projection 33*a* of the supporting member 33 to attach the flyer boss 34 to the supporting member 33, so that the supporting member 33 and flyer boss 34 can freely rotate integrally on the brake disc 25.

Figure 4:
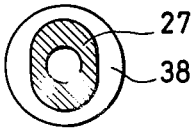
FIG. 4 is a plan view showing a washer.

A nut 36 having fixed thereto a top guide 35 including a yarn guide hole 35*a* is screwed and secured to the top end portion of the yarn guide tube 27 piercing through the flyer boss supporting member 33, and a second spring 37 is spirally wound between the nut 36 and the flyer boss supporting member 33. A washer 38 which is pressed to the lower end of the spring 37 has a substantially ellipsoidal hole as shown in FIG. 4, and in the vicinity of this washer 38, the yarn guide tube 27 has an ellipsoidal shape, so that the washer 38 is prevented from rotating even with rotation of the flyer boss supporting member 33 and no torque is applied to the spring 37.

Flyers 39 are secured to the flyer boss 34, one being for unwinding the yarn and the other being a balancing flyer.

The first spring 23 urges upwardly the yarn guide tube 27 through the spring seat 28, and in the state where a full bobbin is placed on the bobbin supporting member 31, the spring seat 28 moves downward against the force of the spring 23 by the weight of the bobbin through the pins 30. Accordingly, the yarn guide tube 27 is positioned at a lowest point, and the lower end of the yarn guide pipe 27 is located at a position near the top end of the spindle 4, as indicated by a two-dot chain line in FIG. 2.

A felt piece 40 is disposed to prevent fly wastes from adhering to the bearing 8. In the state where the yarn guide tube 27 is located at the above lowest position, the second spring 37 is pressed and contracted against the lower face of the nut 36 to press down the flyer boss supporting member 33 and increase the pressure of contact between the lower face of the supporting member 33 and the projecting band 25*a* of the brake disc 25, whereby a braking action is imposed on rotation of the flyer boss, that is, rotation of the flyers. Namely, in the state where the quantity of the yarn wound on the yarn feed bobbin, the yarn guide tube 27 is located at a lower position and the spring 37 is contracted to apply a braking action onto rotation of the flyers, with the result that even if the unwinding tension is small, a certain tension is imposed on the yarn. When the quantity of the yarn on the bobbin is decreased and the unwinding tension is increased, the yarn guide tube 27 moves upward with decrease of the yarn quantity, and the pressing force of the second spring 37 is decreased and the braking action on the flyers is decreased.

Figure 7:
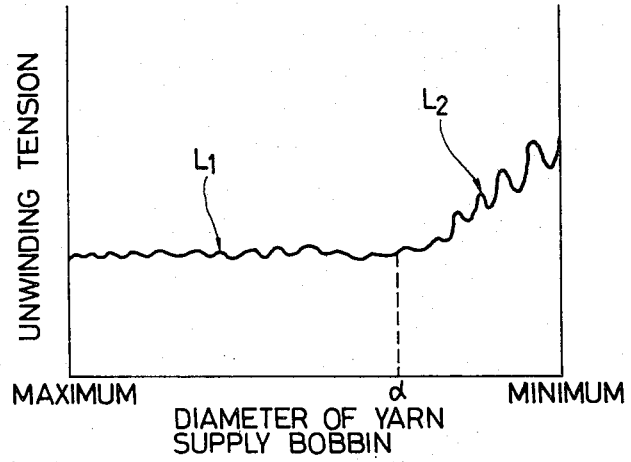
FIG. 7 is a curve illustrating the relation between the diameter of the yarn supply bobbin and the unwinding tension.

As shown in FIG. 7, when the diameter of the yarn supply bobbin is large, the yarn-unwinding tension is maintained at a substantially constant level L1 though there are present minute variations, but if the bobbin diameter is reduced below a certain level $\alpha$, the unwinding tension tends to increase (L2) with large variations. In other words, the smaller is the bobbin diameter, the larger becomes the component of the force in the central direction and the unwinding tension. From the results of experiments, it has been confirmed that the above-mentioned change point $\alpha$ of the unwinding tension appears when the bobbin diameter is reduced to about $\frac{1}{3}$ of the diameter of the full bobbin.

Accordingly, in the present invention, as the first spring 23, there is used a spring having such a spring constant that the compression state can be maintained up to the change point $\alpha$ of the unwinding tension and when the bobbin diameter is reduced to this change point $\alpha$, the spring length is gradually increased to slide the yarn guide tube 27 upward.

Incidentally, the above-mentioned change point $\alpha$ of the unwinding tension is not limited to one critical point, and it covers a certain range. For facilitating the understanding, it has been explained that the unwinding tension changes at one point. The change point $\alpha$ referred to hereinafter covers a certain range.

Figure 9:
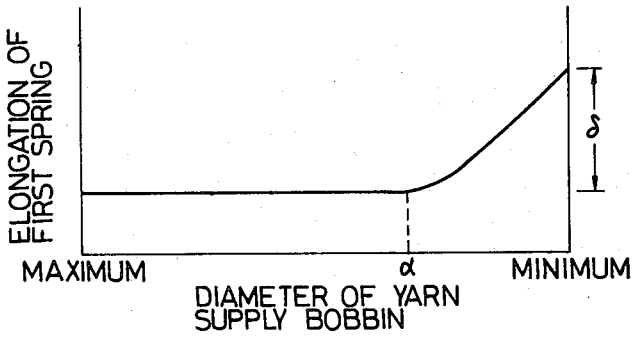
FIG. 9 is a curve illustrating the relation between the diameter of the yarn supply bobbin and the quantity of elongation of a first spring.

Supposing that the weight of the yarn feed bobbin is decreased by P Kg when the spring is extended by $\delta$ mm in FIG. 9 and the inherent total weight of the apparatus including the bobbin supporting member 31, spring seat 28, yarn guide tube 27 and the like is W Kg, the spring constant K satisfying the above requirements is expressed by the following formula:

$$K=(P+W)/\delta=Gd^4/8D^3N$$

wherein G stands for the lateral elastic modulus of the material, d stands for the diameter of the spring wire, D stands for the average diameter of the spring and N represents the effective wind number.

Figure 5:
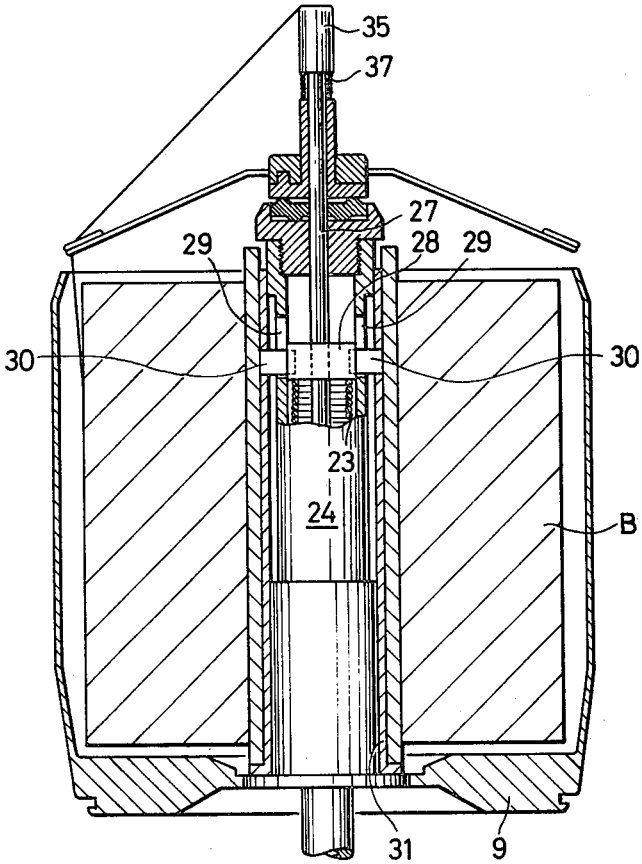
FIG. 5 is a sectional front view illustrating the state where a full bobbin is mounted on a bobbin supporting member.

When a full bobbin is inserted and fitted in the bobbin supporting member 31, the flyer boss 34 shown in FIG. 2 is pulled out upward along the supporting member 33, and in the state where the flyers are removed, insertion of the yarn supply bobbin is effected. FIG. 5 illustrates the state where a yarn supply bobbin B is mounted on the bobbin supporting member 31. More specifically, the bobbin supporting member 31 having the full bobbin B supported thereon is moved downward by the weight thereof and is set on the stationary disc 9. Also the pins 30 fitted in the bobbin supporting member 31 are moved downward along the long holes 29 formed on the spring case 24, and the yarn guide tube 27, together with the spring seat 28, is brought down to the lowest position against the first spring 23.

When the compressed air supply valve 20 shown in FIG. 1 is connected to the lower end of the spindle 4 in this state, compressed air is jetted into the yarn guide tube 15 of the yarn storing board 6 through the air hole 19 of the spindle 4, and the sucking force produced by the jetted air stream is applied to the yarn guide hole 35*a* of the top guide 35 through the yarn guide hole 16 and yarn guide tube 27. Accordingly, if the end of the yarn taken out of the yarn supply bobbin is placed on the top end of the top guide 35, the yarn end is carried by the suction air stream and is released to the outside of the yarn storing board 6 through the yarn guide tube 27, the yarn guide hole 16 of the spindle 4 and the yarn guide tube 15 of the yarn storing board 6. Then, the yarn end rises from the inclined wall 11*a* of the outer ring 11 along a space between the side wall 9*a* of the stationary board 9 and the balloon regulating cylinder 13. When the yarn end arrives at the top end of the balloon restricting cylinder 13, the yarn end is caught by a hand of an operator and is wound on a winding bobbin not shown in the drawings. Thus, the yarn passing operation is completed.

When the operation of the double twister having the above-mentioned structure is initiated, the yarn unwound from the bobbin B passes through the flyers 39, and while the yarn rotates the flyers 39, the yarn is introduced into the yarn guide tube 27 from the top guide 35. Since the unwinding tension is small in the initial stage, if the flyers receive no braking action and are allowed to rotate, the yarn is wound around the periphery of the yarn storing disc 6, but in the apparatus of the present invention, since the flyers 39 receive the pressing force of the spring 37 and the braking action is thus imposed on the flyers 39, a certain tension is applied to the yarn and the yarn is ballooned after it has been wound on the periphery of the yarn storing board by about on turn.

Figure 6:
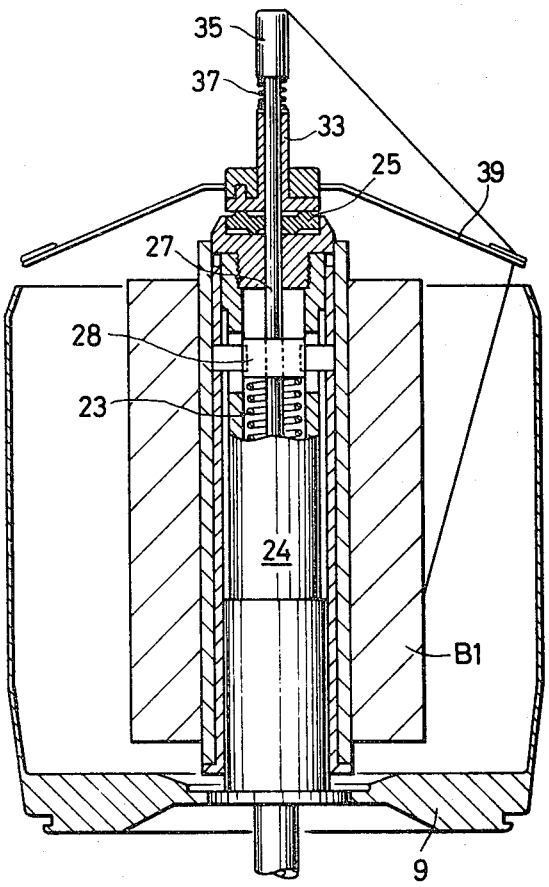
FIG. 6 is a sectional front view illustrating the position of a yarn guide pipe when the diameter of a yarn supply bobbin is decreased.
Figure 8:
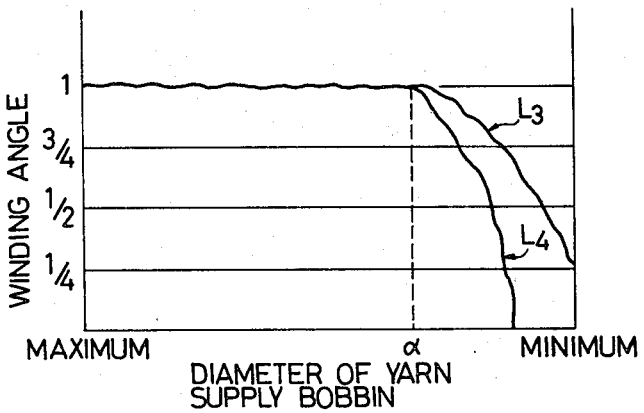
FIG. 8 is a curve illustrating the relation between the diameter of the yarn supply bobbin and the winding angle of the yarn on a yarn storing disc.

While the diameter of the yarn supply bobbin is gradually decreased to the change point of the unwinding tension, the yarn supply bobbin is located at a lowest position against the force of the first spring and the yarn is wound on the yarn storing board substantially uniformly. However, if the diameter of the yarn supply bobbin is reduced below the change point shown in FIG. 7, the unwinding tension is increased. If in this state the braking action is imposed on the flyers in the same manner as described above, the tension on the yarn is excessively increased and the yarn is not wound on the yarn storing board any more, with the result that variations of the tension are not absorbed and yarn breakage takes place. Accordingly, in the apparatus of the present invention, if the diameter of the yarn supply bobbin B1 is reduced below the change point $\alpha$, as shown in FIG. 6, the spring base 28 is gradually moved upward along the inner face of the spring case 24 by the action of the first spring 23, and also the yarn guide tube 27 having the spring seat 28 secured thereto is similarly moved. With rising of the yarn guide tube 27, the second spring 37 which has been contracted by the pressing force of the top guide 35 is gradually extended and the contact pressure between the flyer boss supporting member 33 and the brake disc 25 is gradually decreased by the spring 37, with the result that rotation of the flyers 39 is gradually smoothened. Accordingly, the tension imposed on the yarn by the braking force of the flyers 39 is reduced, and even if the unwinding tension on the yarn is increased, a certain winding angle of the yarn on the yarn storing disc 6 can be guaranteed. More specifically, as indicated by curve L3 shown in FIG. 8, after the bobbin diameter has been reduced below the change point $\alpha$, the winding angle of the yarn on the yarn storing disc 6 is reduced, but the winding angle is not reduced to zero before the quantity of the yarn on the bobbin is reduced to zero. Incidentally, curve L4 indicates changes of the winding angle observed when the braking action is continuously imposed on the flyers. In this case, the winding angle is substantially constant before the bobbin diameter is reduced to the change point $\alpha$ of the unwinding tension, but if the bobbin diameter is reduced below this change point $\alpha$, the winding angle is abruptly decreased, and the winding angle is reduced to zero before the quantity of the yarn on the bobbin is reduced to zero, with the result that variations of the unwinding tension cannot be absorbed and such troubles such as variations of the balloon tension and yarn breakages are caused to occur.

The second spring 37 may have an urging force smaller than that of the first spring 23, and the force of raising the yarn supply bobbin is given mainly by the first spring 23. The force of the second spring 37 is very small, and it is sufficient if the second spring 37 has an urging force enough to press the flyer boss 34 to the brake disc 25.

As is apparent from the foregoing description, according to the present invention, a spring seat is secured to the interior of a spring case of a hollow yarn guide pipe piercing through the center of the spring case secured to the central cylindrical portion of a stationary board, a first spring is spirally wound between the spring seat and the bottom of the spring case, pins projected in the radial direction of the spring seat are fitted in a bobbin supporting member through long holes formed on the spring case, the lower end of the yarn guide disc is brought close to the top end of a yarn guide hole of a spindle, the top end of the yarn guide tube is extended upward through a brake disc secured to the top end of the spring case and a flyer boss supporting member rotatably mounted on the brake disc, a second spring is spirally wound between the lower face of a top guide secured to the top end of the yarn guide tube and the top face of the flyer boss supporting member, and the first spring is arranged so that the first spring exerts an urging force of raising the yarn guide tube after the point when the bobbin diameter is reduced to the change point of the unwinding tension. According to the present invention, by virtue of these characteristic features, the sucking action by an air stream jetted into the yarn guide tube of the yarn storing disc is transmitted even to the top guide through the yarn guide hole of the spindle and the yarn guide tube piercing through the spring case, whereby the yarn passing operation can be facilitated, and while the unwinding tension on the yarn from the yarn feed bobbin is small, a braking force is applied to flyers to maintain a constant winding angle of the yarn on the yarn storing disc and when the unwinding tension begins to increase, the braking force on the flyers is gradually released to guarantee a certain winding angle of the yarn on the yarn storing disc. Accordingly, in the present invention, variations of the unwinding tension can be absorbed as effectively as in the conventional apparatus using a capsule tensor or ball tensor, and therefore, a uniform balloon tension can always be maintained.

What is claimed is:

1. A double twister provided with a pneumatic yarn guide means and tension regulating means, said double twister comprising a supply bobbin having a central hole;

a hollow yarn guide tube inserted vertically and slidably in said central hole of said yarn supply bobbin;

a cylindrical bobbin supporting member with a flange for supporting a bobbin, said member being pin connected to said yarn guide tube so that said yarn guide tube and said bobbin supporting member are integrally moved in a vertical direction;

a first spring for urging upward said yarn guide tube and said bobbin supporting member;

a brake disc;

a flyer boss supporting member mounted freely rotatable at the top end of said bobbin supporting member through said brake disc and through which said yarn guide tube is inserted; and a second spring spirally wound on the upper end portion of said yarn guide tube thereby to bring said flyer boss supporting member into pressing contact with said brake disc when said yarn guide tube is located at a lower position.

2. The twister of claim 1, wherein said first spring has a spring constant whereby a compression state can be maintained up to a change point of an unwinding tension, and whereby when said bobbin diameter is reduced to said change point, the length of said first spring is gradually increased to slide said yarn guide upward.

3. The twister of claim 1, wherein said upper end portion of said yarn guide tube comprises a top guide secured to the top end of said yarn guide tube and wherein said second spring is wound on said yarn guide tube between the lower face of said top guide and a top face of said flyer boss supporting member, and wherein said second spring has a small urging force sufficient to press a flyer boss to said brake disc.

4. The twister of claim 1, further comprising a stationary disc; and a cylindrical spring case having an interior and long holes formed therein, said spring case being for said first spring and screwed to a central portion of said stationary disc; and a disc-like spring seat fixed at a predetermined position of said yarn guide tube inserted in said interior of said spring case; pins piercing through said long holes formed in said spring case and being screwed to said spring seat at one end thereof and fitted in said bobbin supporting member at another end so that the vertical movement of said yarn guide tube and said bobbin supporting member can be regulated by the length of said hole of said spring case.

5. The twister of claim 1, wherein said brake disc is formed by cutting off a peripheral surface portion from a disc so that it is immovably disposed in a upper recess of a brake disc supporting member and an annular projecting band is formed on one surface of said disc brake and an annular projecting band having a smaller diameter than that of said former band, is formed on the other surface of said brake disc.

* * * * *